US009004025B2

(12) United States Patent
Shinomiya

(10) Patent No.: US 9,004,025 B2
(45) Date of Patent: Apr. 14, 2015

(54) VARIABLE VALVE TIMING CONTROL APPARATUS OF INTERNAL COMBUSTION ENGINE

(75) Inventor: Toru Shinomiya, Atsugi (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 270 days.

(21) Appl. No.: 13/310,880

(22) Filed: Dec. 5, 2011

(65) Prior Publication Data

US 2012/0174884 A1 Jul. 12, 2012

(30) Foreign Application Priority Data

Jan. 12, 2011 (JP) ..... 2011-003794

(51) Int. Cl.
*F01L 1/34* (2006.01)
*F01L 1/344* (2006.01)

(52) U.S. Cl.
CPC ..... *F01L 1/3442* (2013.01); *F01L 2001/34456* (2013.01); *F01L 2001/34469* (2013.01); *F01L 2001/34483* (2013.01)

(58) Field of Classification Search
CPC ..... F01L 2001/34483
USPC ..... 123/90.15, 90.17; 464/160, 161; 74/567
See application file for complete search history.

(56) References Cited

U.S. PATENT DOCUMENTS 6,276,321 B1 * 8/2001 Lichti et al. ..... 123/90.17
7,240,650 B2 * 7/2007 Imaizumi et al. ..... 123/90.17
7,503,294 B2 * 3/2009 Ogawa et al. ..... 123/90.16
2005/0252468 A1 * 11/2005 Tanaka et al. ..... 123/90.17
2007/0095199 A1 5/2007 Ogawa et al.
2009/0250028 A1 * 10/2009 Fujiyoshi et al. ..... 123/90.17
2010/0116233 A1 * 5/2010 Weisser et al. ..... 123/90.17
2011/0073055 A1 * 3/2011 Kobayashi et al. ..... 123/90.17

FOREIGN PATENT DOCUMENTS

JP 2005-180378 A 7/2005
JP 2009-185766 A 8/2009
JP 2009-222037 A 10/2009

OTHER PUBLICATIONS

Japanese Office Action dated May 7, 2014 (three (3) pages).

* cited by examiner

*Primary Examiner* — Thomas Denion
*Assistant Examiner* — Daniel Bernstein
(74) *Attorney, Agent, or Firm* — Crowell & Moring LLP

(57) ABSTRACT

A variable valve timing control apparatus has a housing having a plurality of working fluid chambers, a vane member rotatably housed in the housing and dividing the each working fluid chamber into advance and retard oil chambers, the vane member rotating to a most-advanced angle side and to a most-retarded angle side within a predetermined angle range relative to the housing, and a torsion spring, one end of which is retained by the housing and the other end of which is retained by the vane member. When the vane member rotates to the most-advanced angle side and to the most-retarded angle side, an angle formed by a line connecting the both ends of the torsion spring through an axial center of the vane member ranges from an angle positioned at one side to an angle positioned at the other side of a boundary with 180° being the boundary.

16 Claims, 6 Drawing Sheets

VARIABLE VALVE TIMING CONTROL APPARATUS OF INTERNAL COMBUSTION ENGINE

BACKGROUND OF THE INVENTION

The present invention relates to a variable valve timing control apparatus of an internal combustion engine, which variably controls open and closing timing of an intake valve and/or an exhaust valve of the engine in accordance with an engine operating condition.

A generally used vane type variable valve timing control apparatus is configured so that, in a state in which an application force by a hydraulic pressure does not act on the variable valve timing control apparatus upon stop of the engine, a vane member is positioned at a retarded angle side with respect to a timing sprocket with stability, due to an alternating torque occurring at a camshaft.

On the other hand, recently, various variable valve timing control apparatuses have been developed. One such variable valve timing control apparatus is disclosed in Japanese Patent Provisional Publication No. 2005-180378 (hereinafter is referred to as "JP2005-180378"). In JP2005-180378, in the case where the application force by the hydraulic pressure does not act on the variable valve timing control apparatus, the vane member is mechanically positioned at an advanced angle side with stability by a spring force of a torsion spring, or the application force is assisted in an advanced angle direction.

With regard to the torsion spring in JP2005-180378, its one end is bent in a radially outward direction and fixed in a retaining groove that is provided in a housing. The other end is bent in a radially inward direction and fixed in a retaining groove that is provided at the vane member.

SUMMARY OF THE INVENTION

In the variable valve timing control apparatus in JP2005-180378, however, an angle formed by two lines connecting an axial center of a vane rotor of the vane member and both ends of the torsion spring is approximately 120° all the time, which is smaller than or equal to 180°. Because of this, the torsion spring is constantly subjected to a force that acts in a direction in which the torsion spring falls down or tips to one side with respect to an axis, then an attitude of the torsion spring is not stable. As a consequence, there is a possibility that the spring force of the torsion spring can not act on the vane member with stability.

It is therefore an object of the present invention to provide a variable valve timing control apparatus that is capable of maintaining the attitude of the torsion spring with stability.

According to one aspect of the present invention, a variable valve timing control apparatus of an internal combustion engine, comprises: a housing to which a turning force is transmitted by an engine crankshaft and which has a plurality of working fluid chambers in an inner circumference of the housing; a vane member rotatably housed in the housing and dividing the each working fluid chamber into an advance oil chamber and a retard oil chamber, the vane member rotating to a most-advanced angle side and to a most-retarded angle side within a predetermined angle range relative to the housing; and a torsion spring, one end of which is retained by the housing and the other end of which is retained by the vane member, and when the vane member rotates to the most-advanced angle side and to the most-retarded angle side relative to the housing, an angle in a circumferential direction formed by a line connecting the one end and the other end of the torsion spring through an axial center of the vane member ranges from an angle positioned at one side to an angle positioned at the other side of a boundary with 180° being the boundary.

According to another aspect of the present invention, a variable valve timing control apparatus of an internal combustion engine, comprises: a drive rotary member to which a turning force is transmitted by an engine crankshaft; a driven rotary member which is capable of rotating within a predetermined angle range relative to the drive rotary member; and a torsion spring, one end of which is retained by the drive rotary member and the other end of which is retained by the driven rotary member, and when the driven rotary member rotates relative to the drive rotary member and is positioned in a substantially middle position within the predetermined angle range, an angle in a circumferential direction formed by a line connecting the one end and the other end of the torsion spring through an axial center of the driven rotary member is 180°.

According to a further aspect of the invention, a variable valve timing control apparatus of an internal combustion engine, comprises: a drive rotary member to which a turning force is transmitted by an engine crankshaft; a driven rotary member which is capable of rotating within a predetermined angle range relative to the drive rotary member; and a torsion spring, one end of which is retained by the drive rotary member and the other end of which is retained by the driven rotary member, and an angle in a circumferential direction formed by a line connecting the one end and the other end of the torsion spring through an axial center of the driven rotary member when the driven rotary member rotates relative to the drive rotary member and is positioned in a middle position of the predetermined angle range is set to an angle of ±5° of 180°.

The other objects and features of this invention will become understood from the following description with reference to the accompanying drawings.

DETAILED DESCRIPTION OF THE INVENTION

Embodiments of a variable valve timing control apparatus of the present invention will be explained below with reference to the drawings. In the following description, the variable valve timing control apparatus (VTC) is applied to a variable valve system for an exhaust valve side of an internal combustion engine. However, it can also be applied to the variable valve system for an intake valve side of the internal combustion engine.

Figure 4:
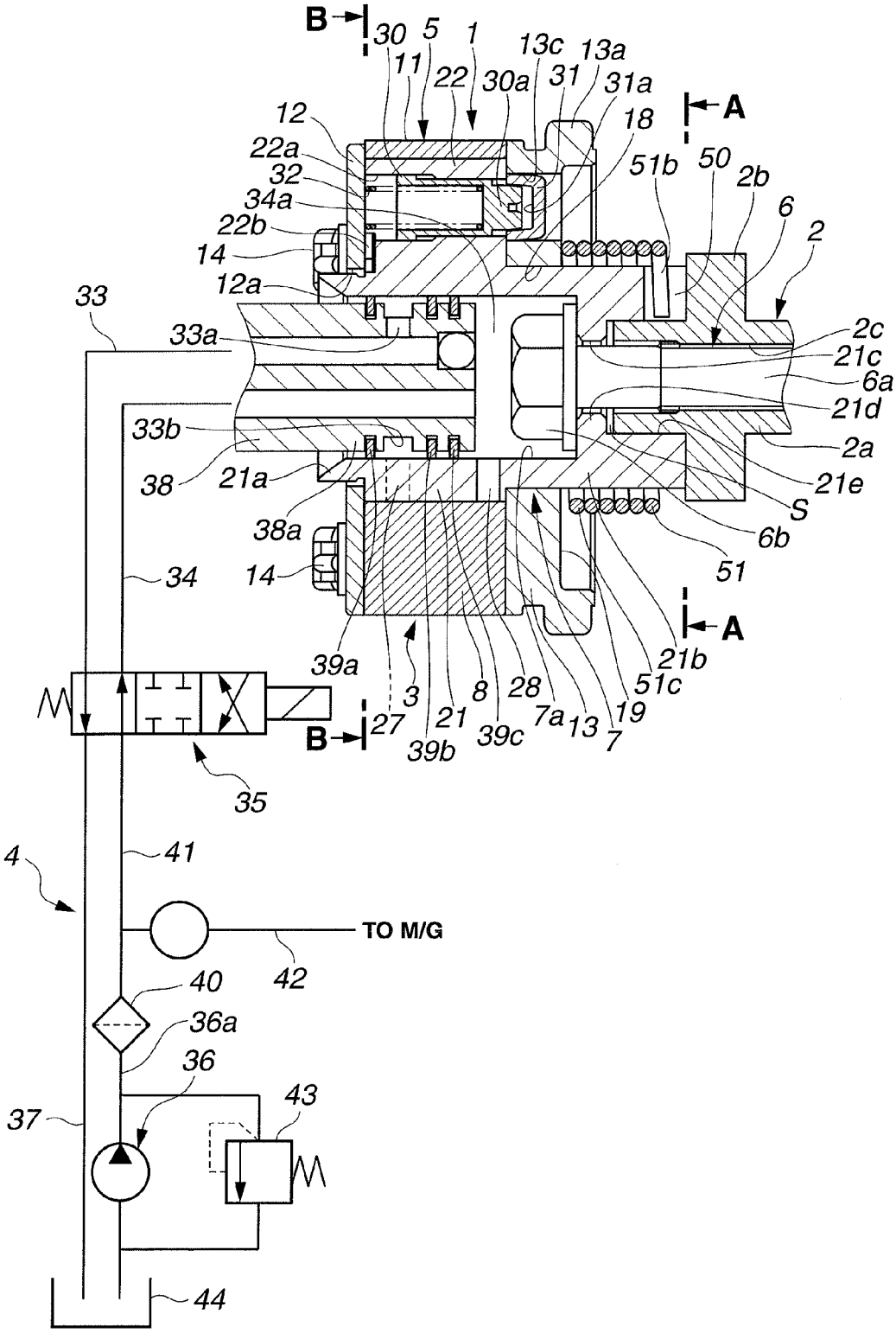
FIG. 4 is a longitudinal cross section of the variable valve timing control apparatus.
Figure 5:
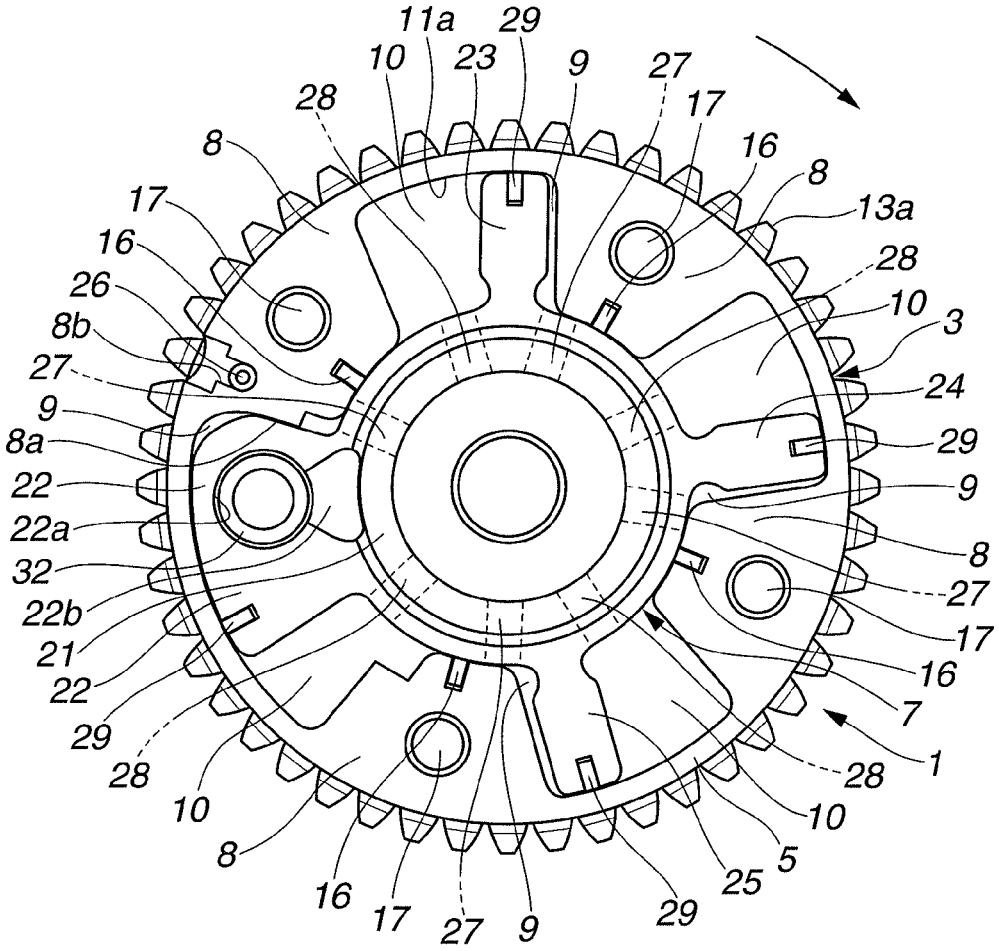
FIG. 5 is a sectional view, viewed from a B-B line in FIG. 4, of the variable valve timing control apparatus, which shows a state in which the vane rotor is positioned at the most-advanced angle side.
Figure 6:
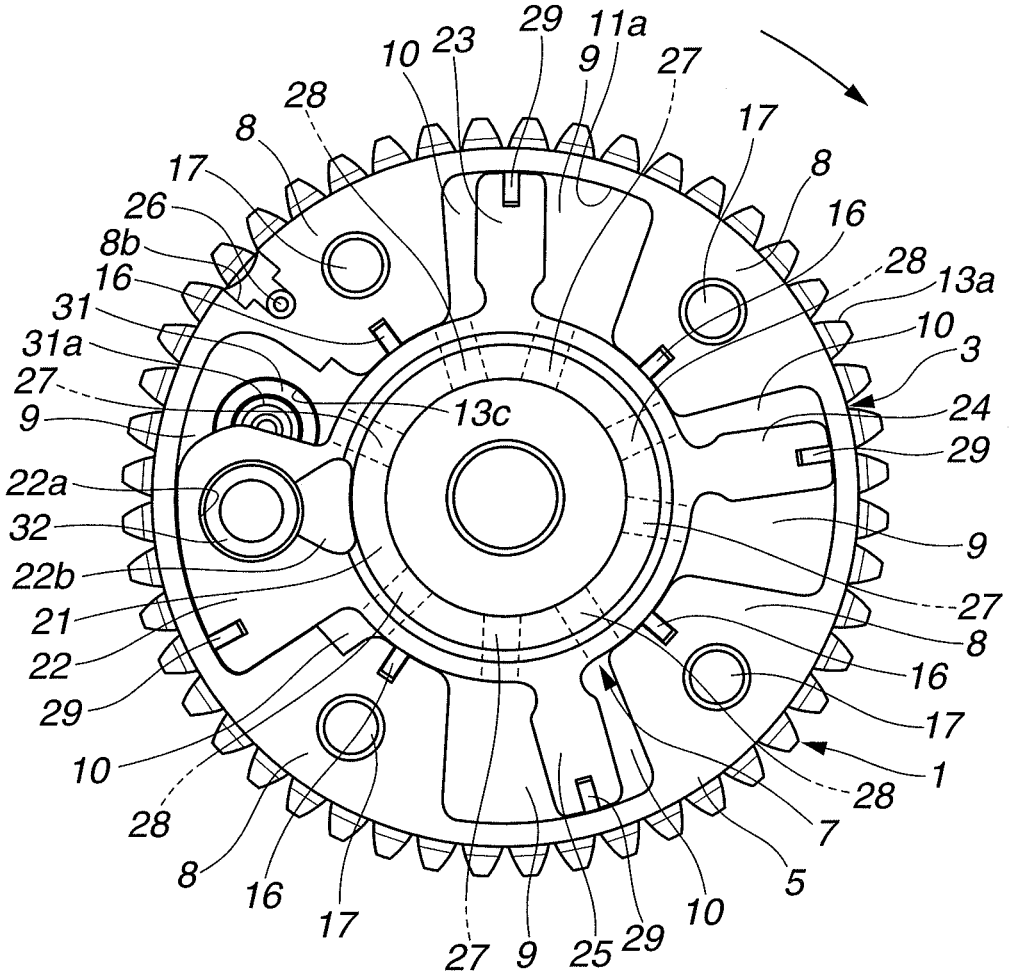
FIG. 6 is a sectional view, viewed from the B-B line in FIG. 4, of the variable valve timing control apparatus, which shows a state in which the vane rotor is positioned at the most-retarded angle side.

As shown in FIGS. 4 to 6, an exhaust side VTC has a timing sprocket 1 as a drive rotary member to which a rotation driving force or a turning force is transmitted by an engine crankshaft (not shown) through a timing chain, an exhaust camshaft 2 as a driven rotary member which is capable of rotating relative to the timing sprocket 1, a relative angular phase control mechanism (simply, a phase converter or a phase-change mechanism) 3 disposed between the timing sprocket 1 and the exhaust camshaft 2 and changing or controlling a relative rotational phase between the timing sprocket 1 and the exhaust camshaft 2, and a hydraulic circuit 4 actuating the phase-change mechanism 3.

The timing sprocket 1 is formed by a plurality of components such as an after-mentioned housing 5 that is a part of the phase-change mechanism 3. As shown in FIGS. 5 and 6, the timing sprocket 1 rotates in a direction indicated by an arrow in the drawings.

The exhaust camshaft 2 is rotatably supported by a cylinder head (not shown) through a camshaft bearing. The exhaust camshaft 2 has a plurality of driving cams, each of which actuates an exhaust valve through a direct-acting valve lifter, and an annular thick flange portion 2*b*. Each driving cam is formed integrally with the exhaust camshaft 2 at a certain position on an outer peripheral surface of the exhaust camshaft 2. The flange portion 2*b* is formed integrally with the exhaust camshaft 2 at a side of one end portion 2*a* of the exhaust camshaft 2. Further, the exhaust camshaft 2 is provided with a female screw hole 2*c* in an axial direction at an inner side of the one end portion 2*a* in order for a cam bolt 6 to screw in. An after-mentioned vane member 7 is secured to the one end portion 2*a* from the axial direction at a top end part of the one end portion 2*a* by the cam bolt 6.

The phase-change mechanism 3 has the housing 5 arranged at the one end portion 2*a* of the exhaust camshaft 2, the vane member 7 secured to the one end portion 2*a* of the exhaust camshaft 2 from the axial direction by the cam bolt 6 and relatively rotatably housed in the housing 5, four shoes 8 formed on an inner peripheral surface of the housing 5 and protruding in a radially inward direction, and four retard oil chambers 9 and four advance oil chambers 10. As can be seen in FIGS. 5 and 6, each of the retard and advance oil chambers 9 and 10 is defined by each shoe 8 and after-mentioned four vanes 22 to 25 of the vane member 7.

The housing 5 has a substantially cylindrical shaped housing main body 11, a front plate 12 that closes a front side opening end of the housing main body 11, and a rear plate 13 that closes a rear side opening end of the housing main body 11. These housing main body 11 and front and rear plates 12 and 13 are tightened together in the axial direction by four bolts 14, then fixedly connected together.

As shown in FIGS. 5 and 6, with respect to the housing main body 11, a normal portion except the shoe 8 is formed thin, and a working fluid chamber defined by the normal portion and the shoe 8 inside the housing 5 is formed. As mentioned above, the retard and advance oil chambers 9 and 10 are defined by the vanes 22 to 25 of the vane member 7 in the working fluid chamber.

The shoes 8 are arranged at almost regular intervals in a circumferential direction. Each shoe 8 has a substantially trapezoidal shape in cross section. A seal groove is formed on a top end part of the trapezoidal shape along the axial direction, and an almost square bracket ("]")-shaped seal member 16 is fitted in the seal groove. Further, each shoe 8 is provided with a bolt insertion hole 17 at a base side of the trapezoidal shape. The insertion hole 17 opens in the axial direction, and each bolt 14 is inserted in the insertion hole 17.

In addition, as can be seen in FIGS. 5 and 6, on one side surface in the circumferential direction of one of the four shoes 8, a protruding portion 8*a* is formed integrally with the shoe 8. This protruding portion 8*a* serves to limit a most-advanced angle rotational position (in an advanced angle rotational direction, i.e. in a right rotation direction, in the drawings) of the vane member 7, by the fact that a side surface of the vane 22 of the vane member 7, which is positioned on the opposite side to the protruding portion 8*a*, touches the protruding portion 8*a* when rotating in the advanced angle rotational direction. Further, a fitting groove 8*b* is formed along a radial direction around the protruding portion 8*a* on an outer peripheral surface of this shoe 8. A positioning pin 26 is fitted in and fixed to the fitting groove 8*b*.

The front plate 12 is formed by pressing, and has a relatively thin disc shape. As shown in FIG. 4, the front plate 12 is provided, in the middle thereof, with a large diameter opening 12*a* into which a front end portion 21*a* of a vane rotor 21 is inserted. Further, the front plate 12 is provided with four bolt insertion holes (not shown) into which each bolt 14 is inserted, at almost regular intervals in a circumferential direction at an outer peripheral side of the front plate 12.

As shown in FIGS. 1 to 4, the rear plate 13 is formed by, for example, sintered alloy, and has a disc shape which is thicker than the front plate 12. The rear plate 13 is provided, in the middle thereof, with a large diameter supporting opening 18 into which the vane rotor 21 is rotatably inserted. Further, a plurality of teeth 13*a* are formed integrally with an outer circumferential portion of the rear plate 13. The turning force is then transmitted to the rear plate 13 with the timing chain wound around the teeth 13*a*. Furthermore, the rear plate 13 is provided with four female screw holes 13*b* in order for a male screw of a top end of each bolt 14 to screw in. These four female screw holes 13*b* are located at a radially inner side of the teeth 13*a*, and arranged at almost regular intervals in the circumferential direction at an outer peripheral side of the rear plate 13.

Figure 1:
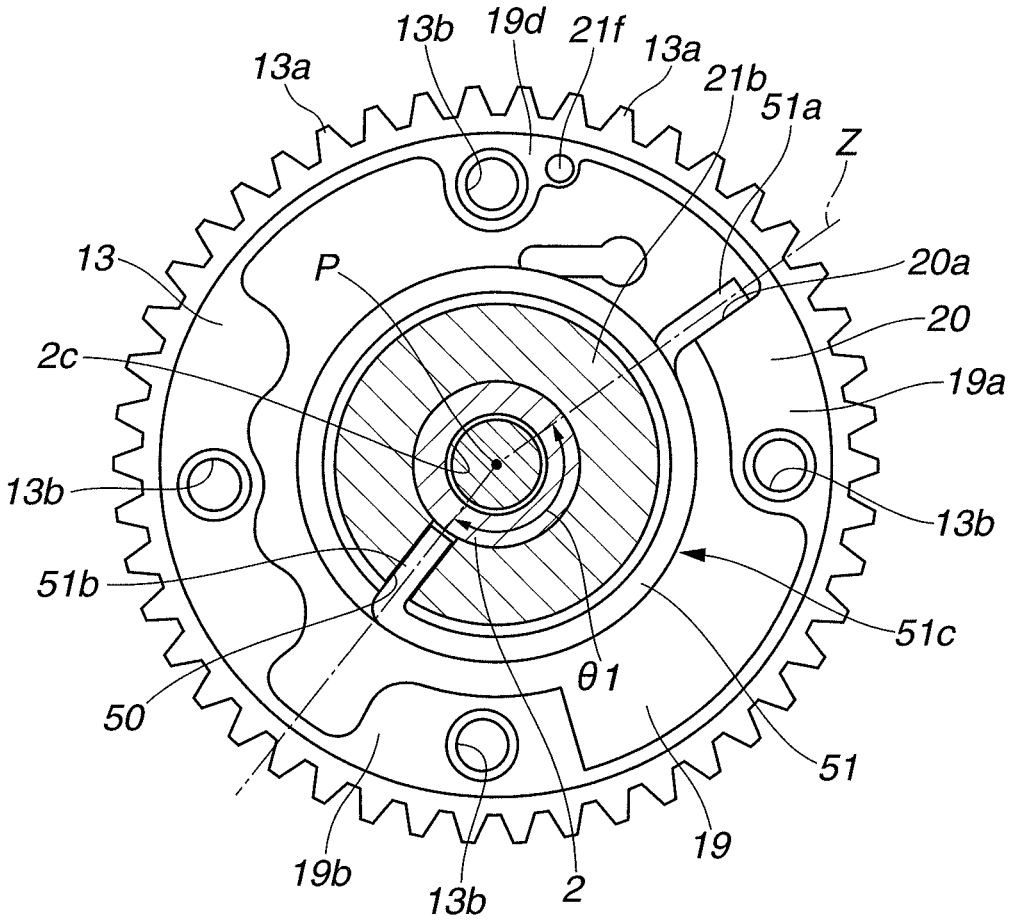
FIG. 1 is a sectional view, viewed from an A-A line in FIG. 4, of a variable valve timing control apparatus according to an embodiment of the present invention, which shows a state in which a vane rotor is positioned at a most-advanced angle side.
Figure 2:
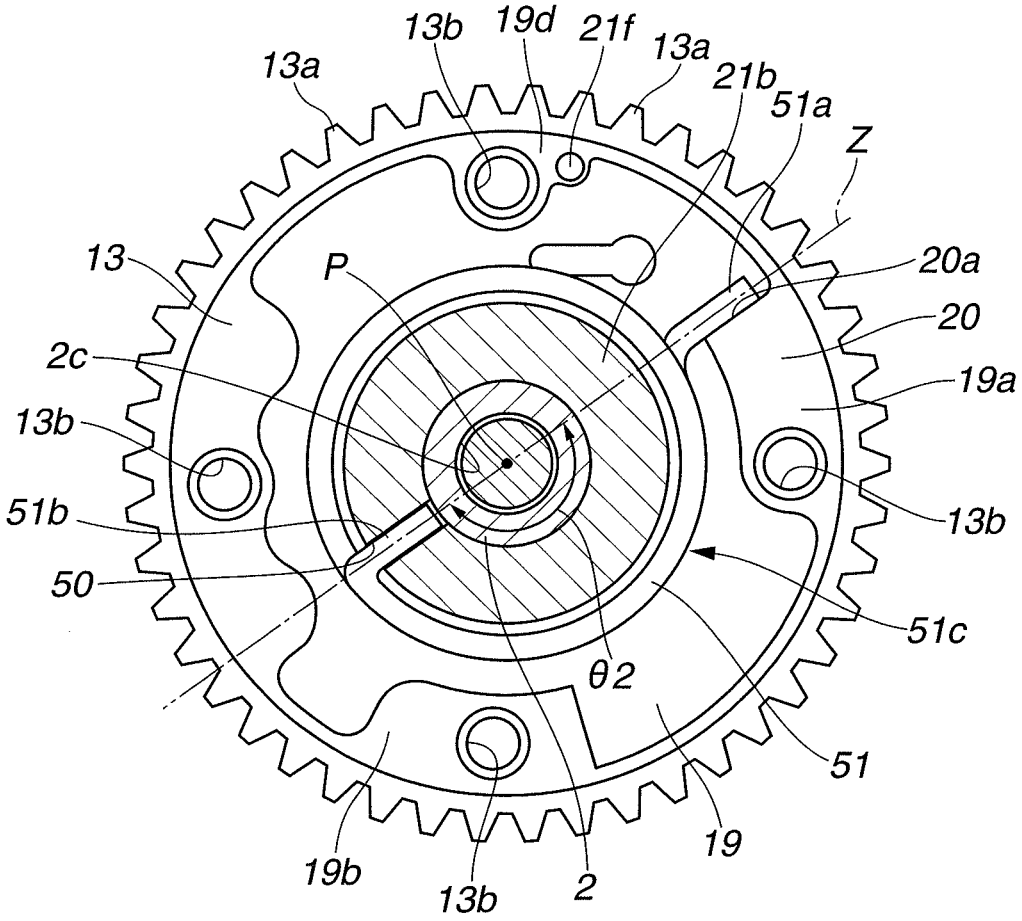
FIG. 2 is a sectional view, viewed from the A-A line in FIG. 4, of the variable valve timing control apparatus, which shows a state in which the vane rotor is positioned in a middle position.
Figure 3:
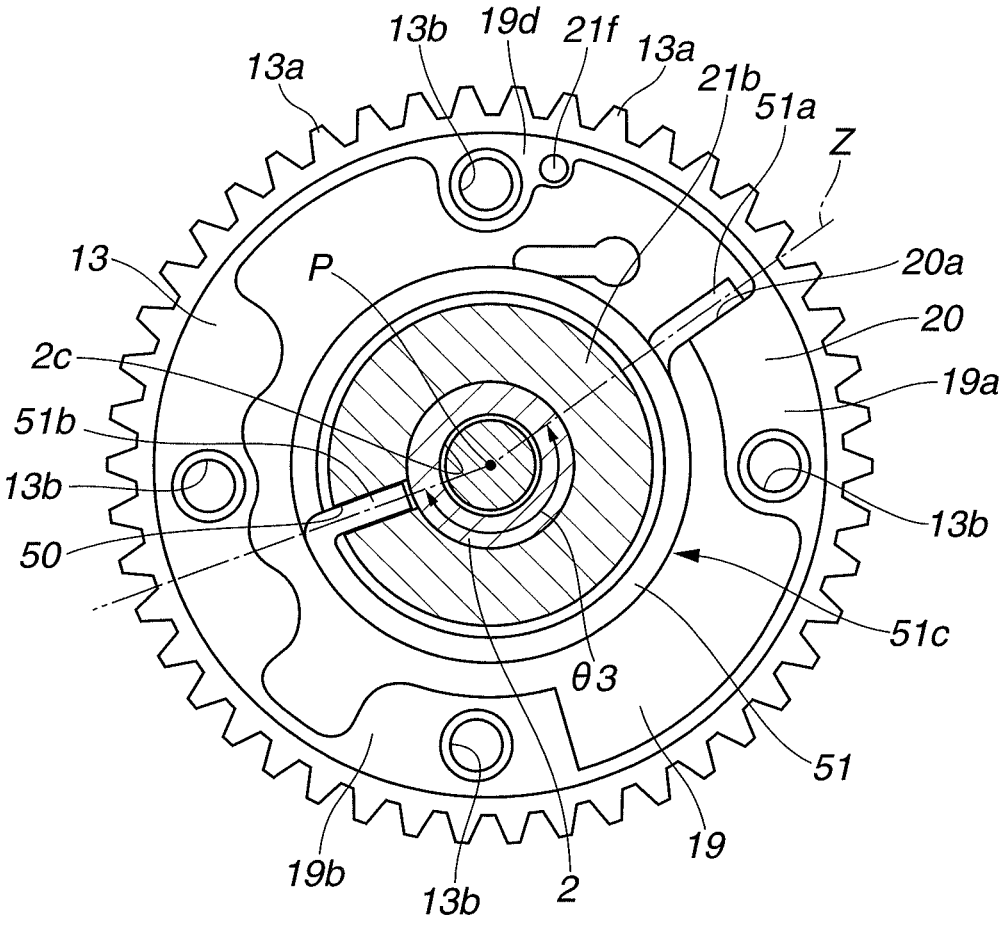
FIG. 3 is a sectional view, viewed from the A-A line in FIG. 4, of the variable valve timing control apparatus, which shows a state in which the vane rotor is positioned at a most-retarded angle side.

Further, as shown in FIGS. 1 to 3, four irregular-shaped boss portions 19*a* to 19*d* are formed at an outer circumferential side of a rear end surface, which is on a camshaft 2 side, of the rear plate 13. The female screw hole 13*b* is formed in each of these boss portions 19*a* to 19*d*. In addition, a concave groove or a concave portion 19, which is a recessed space, is formed in a portion except the boss portions 19*a* to 19*d* formed on the rear end surface of the rear plate 13. The boss portion 19*a* located at a position corresponding to the one shoe 8 is provided with a stopper protrusion (a protruding portion) 20 that is a stopper portion. The stopper protrusion 20 is formed integrally with one side portion in the circumferential direction of the boss portion 19*a*. A flat outer end surface 20*a*, which is one side in the circumferential direction of the stopper protrusion 20, is formed as a spring stopper surface. Furthermore, as shown in FIGS. 4 and 6, a fixing hole 13*c* is provided in a predetermined position of the outer circumferential portion of the rear plate 13. A locking hole unit 31, which forms a locking hole 31*a* of an after-mentioned locking mechanism, is then press-fixed in the fixing hole 13*c*.

The vane member 7 is formed as an integral part by metal material. As shown in FIGS. 4 to 6, the vane member 7 has the vane rotor 21 and the four vanes 22 to 25. The vane rotor 21 is secured to the one end portion 2*a* of the exhaust camshaft 2 from the axial direction by the cam bolt 6 with the cam bolt 6 inserted into an insertion hole 7*a* that is formed in the middle of the vane member 7. The four vanes 22 to 25 are arranged at almost regular intervals in a circumferential direction of an outer circumferential surface of the vane rotor 21, and protrude in the radial direction.

The vane rotor 21 extends toward the camshaft 2 side, and has a substantially cylindrical shape. The front end portion 21*a*, which is a small diameter stepped portion of the vane rotor 21, is inserted into the large diameter opening 12*a* of the front plate 12 with a certain gap provided in the radial direction. On the other hand, a cylindrical portion 21*b* formed integrally with the vane rotor 21 at a rear end side is connected and fixed to the camshaft 2 through the cam bolt 6.

More specifically, the cylindrical portion 21*b* of the vane rotor 21 has a ring-shaped supporting wall 21*d* inside the cylindrical portion 21*b*, and an insertion hole 21*c* into which a shaft portion 6*a* of the cam bolt 6 is inserted is formed in the axial direction in the middle of the supporting wall 21*d*. Moreover, the cylindrical portion 21*b* has a fitting hole 21*e* in which the top end part of the one end portion 2*a* of the camshaft 2 is fitted, at a rear end side of the supporting wall 21*d*.

Further, a rear end surface of the cylindrical portion 21*b* touches a front end surface of the flange portion 2*b* of the camshaft 2. A ring-shaped gap S is formed between a rear end surface of the supporting wall 21*d* and an opposing top end surface of the one end portion 2*a* of the camshaft 2.

Thus, when connecting and fixing the vane rotor 21 to the one end portion 2*a* of the camshaft 2 by the cam bolt 6, an axial force of the cam bolt 6 acts on the supporting wall 21*d* with the rear end surface of the cylindrical portion 21*b* pressed against the front end surface of the flange portion 2*b* of the camshaft 2 by presence of the gap S, thereby firmly securing the vane rotor 21 to the camshaft 2.

As shown in FIGS. 5 and 6, the vane rotor 21 rotates in forward and reverse directions while making sliding contact with the seal member 16 fitted in the seal groove on an upper surface of the top end part of each shoe 8. On a front end portion 21*a* side of the vane rotor 21, four retard side oil passages 27 that communicate with the respective retard oil chambers 9 and four advance side oil passages 28 that communicate with the respective advance oil chambers 10 are provided in the radial direction (see FIG. 4).

As shown in FIGS. 1 to 4, a stopper groove 50 that is the stopper portion is formed along the radial direction in a predetermined position in the circumferential direction of the cylindrical portion 21*b* of the vane rotor 21. This stopper groove 50 is formed into a slit shape along the axial direction from the rear end surface of the cylindrical portion 21*b* to the front end portion 21*a* side by a cutting process. The stopper groove 50 has a width of a certain space in the circumferential direction. Further, a positioning hole (not shown) is provided along the radial direction at the cylindrical portion 21*b* of the vane rotor 21 for positioning between the cylindrical portion 21*b* and the one end portion 2*a* of the exhaust camshaft 2 upon assembly.

Each of the vanes 22 to 25 is placed between the adjacent two shoes 8. A seal groove is formed on a top end surface of each vane along the axial direction, and an almost square bracket ("]")-shaped seal member 29 that makes sliding contact with an inner circumferential surface 11*a* of the housing main body 11 is fitted in the seal groove. As can be seen in FIGS. 5 and 6, the vane 22 has a largest width (a maximum width) as compared with the other vanes 23 to 25. The three vanes 23 to 25 except the vane 2 have a substantially same width, and its width is set to be smaller than the maximum width of the vane 22. Setting of each width of the vanes 22 to 25 to the different width in this way achieves good rotation balance of the whole of the vane member 7 (ensures uniform rotation of the whole of the vane member 7).

Between the vane 22 having the maximum width and the rear plate 13, the locking mechanism that restrains free rotation of the vane member 7 is provided.

The locking mechanism has a lock piston 30 slidably housed or held in a sliding hole 22*a* that is formed at and penetrates the vane 22 of the maximum width in the axial direction and freely moving toward or away from the rear plate 13 side, the locking hole 31*a* formed in the locking hole unit 31 of the rear plate 13 and receiving therein a top end portion 30*a* of the lock piston 30 for engagement (for the lock) or releasing therefrom the top end portion 30*a* for disengagement (for release of the lock), and a locking/releasing mechanism engaging and disengaging the lock piston 30 with and from the locking hole 31*a* in accordance with an engine start condition.

The lock piston 30 is formed into a cylindrical pin shape. The top end portion 30*a* of the lock piston 30 has a stepped truncated conical shape, which can easily engages with the locking hole 31*a* from the axial direction.

Here, as shown in FIGS. 4 to 6, a triangular cutting groove 22*b* is formed at an edge of the sliding hole 22*a* at a front plate 12 side. This cutting groove 22*b* and the large diameter opening 12*a* of the front plate 12 communicate with each other all the time within a rotation range of the vane member 7, thereby functioning as an air releasing vent for ensuring good sliding movement of the lock piston 30.

As can be seen in FIGS. 4 to 6, a position of the locking hole 31*a* is set, in the circumferential direction, at the retard oil chamber 9 side so that when the lock piston 30 is engaged with the locking hole 31*a*, the relative rotational position between the housing 5 and the vane member 7 is the most-advanced angle rotational position.

The locking/releasing mechanism is provided between a rear end portion of the lock piston 30 and an inner end portion of the front plate 12. The locking/releasing mechanism has a coil spring 32 that forces the lock piston 30 in a forward direction (in an engagement direction), and a lock cancelling hydraulic circuit (not shown) that supplies a hydraulic pressure to an inside of the locking hole 31*a* to move the lock piston 30 in a backward direction (in a disengagement direction). This lock cancelling hydraulic circuit is configured so that a hydraulic pressure selectively supplied to the retard oil chamber 9 and the advance oil chamber 10 is supplied to the locking hole 31*a* through a certain oil passage, then acts on the lock piston 30 in the backward direction.

The hydraulic circuit 4 selectively supplies the hydraulic pressure in each of the retard and advance oil chambers 9 and 10 or discharges the oil supplied in the retard and advance oil chambers 9 and 10. As shown in FIG. 4, the hydraulic circuit 4 has a retard oil passage 33 that communicates with each retard side oil passage 27, an advance oil passage 34 that communicates with each advance side oil passage 28, an oil pump 36 that selectively supplies the hydraulic pressure in the oil passages 33 and 34 through an electromagnetic switching valve 35, and an oil drain passage 37 that selectively communicates with the oil passages 33 and 34 through the electromagnetic switching valve 35.

The retard and advance oil passages 33 and 34 are formed in a cylindrical oil passage unit 38, and a top end portion 38*a* of this oil passage unit 38 is inserted in the front end portion 21*a* of the vane rotor 21. The oil passage unit 38 is supported by the cylinder head. The retard oil passage 33 and the retard side oil passage 27 communicates with each other through a radial direction hole 33*a* formed at the top end portion 38*a* and a groove 33*b* formed at an outer circumference of the top end portion 38*a*. In addition, an oil chamber 34*a* defined by a top end surface of the top end portion 38*a* and a head 6*b* of the cam bolt 6 is formed inside the vane rotor 21. The advance oil passage 34 and the advance side oil passage 28 communicates with each other through the oil chamber 34*a*.

The top end portion 38*a* is provided, on the outer circumference thereof, with three seal members 39*a* to 39*c*. These seal members 39*a* to 39*c* are fitted and fixed to the outer circumference of the top end portion 38*a*. The seal member 39*a* seals a gap between an external side and the groove 33*b*, and the seal members 39*b* and 39*c* seal a gap between the groove 33*b* and the oil chamber 34*a*.

The oil pump 36 connects, through an oil discharge passage 36*a* and a filter 40, to an oil supply passage 41 that connects to the electromagnetic switching valve 35. The oil pump 36 also connects, through the oil discharge passage 36*a* and the filter 40, to a main oil gallery (a main pressure oil duct) 42 that supplies lubricant to sliding parts in the engine. The oil pump 36 is provided with a relief valve 43 that suppresses an excessive discharge pressure.

The electromagnetic switching valve 35 is a two-way valve, and selectively switches the retard and advance oil passages 33 and 34, the oil supply passage 41 communicating with the oil discharge passage 36*a* of the oil pump 36, and the oil drain passage 37 by an output signal from a controller (not shown).

The controller has a computer, and inputs information signal from sensors such as a crank angle sensor, an airflow meter, an engine temperature sensor and a throttle valve opening sensor (all not shown), and detects a current engine operating condition. Further, the controller outputs a control pulse current to an electromagnetic coil of the electromagnetic switching valve 35 in accordance with the engine operating condition.

As shown in FIGS. 1 to 4, a torsion spring 51 is provided on an outer circumference of the cylindrical portion 21*b* of the vane rotor 21.

The torsion spring 51 is set with a predetermined clearance in the radial direction provided between an inner surface of the torsion spring 51 and the outer circumferential surface of the cylindrical portion 21*b*, thereby allowing torsion deformation of the torsion spring 51. Further, the torsion spring 51 is set so that a part 51*c* of a front end side of the torsion spring 51 is housed or held in an inside of the concave portion 19.

Moreover, both end portions 51*a* and 51*b* of the torsion spring 51 are retained by or fixed to the rear plate 13 and the vane rotor 21 respectively, then the torsion spring 51 forces the vane rotor 21 so that the rotational phase of the camshaft 2 relative to the timing sprocket 1 shifts to the advanced angle side.

As shown in FIGS. 1 to 3, one end portion 51*a* of the torsion spring 51 is bent in a radially outward direction. The one end portion 51*a* makes elastic contact with the outer end surface 20*a* of the stopper protrusion 20 formed integrally with the boss portion 19*a* from the circumferential direction, then is fixed to or retained by the outer end surface 20*a*. On the other hand, the other end portion 51*b* is bent in a radially inward direction. The other end portion 51*b* is engaged with or inserted in the stopper groove 50 of the cylindrical portion 21*b* of the vane rotor 21 from the radially outward direction, then is fixed to or retained by the stopper groove 50. With this setting, the torsion spring 51 provides the vane rotor 21 with a spring force in the most-advanced angle rotational direction relative to the rear plate 13 (the housing 5).

More specifically, positions of the both end portions 51*a* and 51*b* are set so that when the vane rotor 21 rotates relative to the housing 5 within a rotational range from the most-advanced angle rotational position to a most-retarded angle rotational position, an angle θ in the circumferential direction formed by two lines (called a line Z) passing through an axial center P of the vane rotor 21 (the cylindrical portion 21*b*) and connecting the axial center P and each axis of the one end portion 51*a* and the other end portion 51*b* ranges from an angle positioned at one side to an angle positioned at the other side of a boundary with 180° being the boundary. In other words, when the vane rotor 21 rotates relative to the housing 5 from the most-advanced angle rotational position to the most-retarded angle rotational position, the angle θ changes with the angle θ crossing 180°.

That is to say, although fixing or retaining positions of the one end portion 51*a* and the other end portion 51*b* are determined by a position of the outer end surface 20*a* of the stopper protrusion 20 and a position where the stopper groove 50 is formed, in the present invention, on the basis of the positions of the outer end surface 20*a* and the stopper groove 50, the torsion spring 51 is set so that the angle θ formed by the line Z connecting the axes of the both end portions 51*a* and 51*b* through the axial center P of the cylindrical portion 21*b* is an angle in the neighborhood of 180° with 180° being a center, even when the vane rotor 21 is positioned in any relative rotational position.

As will be explained in detail using the drawings, as shown in FIG. 1, when the vane rotor 21 is positioned in the most-advanced angle rotational position, the angle θ is set so as to be an angle θ1 that is slightly smaller than 180°. As shown in FIG. 3, when the vane rotor 21 is positioned in the most-retarded angle rotational position, the angle θ is set so as to be an angle θ3 that is slightly greater than 180°. Further, as shown in FIG. 2, when the vane rotor 21 is positioned in a middle position between the most-advanced angle and the most-retarded angle, an angle θ2 is set so as to be substantially 180°. In this way, the angle θ is set so as to be the angle ranging from the angle of the one side to the angle of the other side of the boundary with 180° being the boundary between the most-advanced angle side and the most-retarded angle side.

Next, operation of the present invention will be explained. Just before an engine stop, supply of the hydraulic pressure to the retard oil chamber 9 and the advance oil chamber 10 stops, and the vane member 7 relatively rotates up to the most-advanced angle rotational position (an initial position) as shown in FIG. 5 by the spring force (an urging force) in the advanced angle direction of the torsion spring 51. Also the lock piston 30 moves in the forward direction by the spring force of the coil spring 32, the top end portion 30*a* is then engaged with the locking hole 31*a*. With this working, the relative rotation of the vane member 7 is restrained.

Subsequently, when turning an ignition on and starting to crank the engine, the oil pump 36 also starts working. Since the discharge pressure of the oil pump 36 is not sufficient just after the engine and pump startup, an oil supply amount to the exhaust side VTC is insufficient. However, as shown in FIG. 5, the top end portion 30*a* of the lock piston 30 is previously inserted in and engaged with the locking hole 31*a*, and the position of the vane member 7 is restrained in the advanced angle side position which is suitable for the engine start. Consequently, good engine startability can be ensured by the smooth cranking. Also a rattling movement of the vane member 7 due to an alternating torque that acts on the exhaust camshaft 2 can be suppressed.

After that, when the engine operating condition is in a predetermined low rotation speed low load region after the engine start, the controller stops the current application to the electromagnetic coil of the electromagnetic switching valve 35. With this operation, the oil discharge passage 36*a* (the oil supply passage 41) of the oil pump 36 and the advance oil passage 34 are connected to each other, and the retard oil passage 33 and the oil drain passage 37 are connected to each other.

Thus, working fluid (the oil) discharged from the oil pump 36 flows into each advance oil chamber 10 through the advance oil passage 34, then each advance oil chamber 10 becomes a high pressure. On the other hand, the working fluid in the retard oil chamber 9 is discharged in an oil pan 44 from the oil drain passage 37 through the retard oil passage 33, then each retard oil chamber 9 becomes a low pressure.

At this time, since the working fluid flowing into each advance oil chamber 10 is supplied to the locking mechanism, the lock piston 30 moves in the backward direction and comes out of the locking hole 31*a* (disengaged with the locking hole 31*a*), the lock is then released. With this working, although the free rotation of the vane member 7 is allowed and open and closing timing of the exhaust valve can be arbitrarily changed, in a case of this state, the vane member 7 is maintained at the advanced angle side.

On the other hand, for instance, when the engine operating condition shifts to a middle rotation speed region, the controller outputs a predetermined duty control current to the electromagnetic switching valve 35, then the oil discharge passage 36*a* and the retard oil passage 33 are connected to each other, also the advance oil passage 34 and the oil drain passage 37 are connected to each other.

The working fluid in the advance oil chamber 10 is therefore discharged, and each advance oil chamber 10 becomes the low pressure. Also the retard oil chamber 9 is supplied with the working fluid, and each retard oil chamber 9 becomes the high pressure. At this time, since the hydraulic pressure is supplied to the locking mechanism from each retard oil chamber 9, a disengagement state in which the lock piston 30 comes out of the locking hole 31*a* is maintained.

Thus, the vane member 7 rotates relative to the housing 5 in a counterclockwise direction as shown in FIG. 6, then the rotational phase of the camshaft 2 relative to the timing sprocket 1 shifts to the retarded angle side.

As a consequence, the open and closing timing of the exhaust valve is controlled at the retarded angle side, and a valve overlap between the intake valve and the exhaust valve becomes great, thereby improving engine combustion efficiency in the middle rotation speed region.

Further, in this embodiment, as described above, the vane member 7 is forced in the advanced angle direction by the spring force of the torsion spring 51. Hence, since it is possible to forcibly control the open and closing timing of the exhaust valve at the most-advanced angle side, for example, upon stop of the engine, the engine startability can be improved.

Furthermore, in this embodiment, the angle θ formed by the one end portion 51*a* and the other end portion 51*b* of the torsion spring 51 through the axial center P of the vane rotor 21 is brought close to 180°. With this setting, a turning force (couple of forces) that acts on the torsion spring 51 can be suppressed.

In addition, even when the relative rotational phase of the exhaust VTC shifts to the advanced angle side or the retarded angle side, the angle θ formed by the both end portions 51*a* and 51*b* of the torsion spring 51 through the axial center P of the vane rotor 21 is set so as to be 180° or the angle in the neighborhood of 180°. Therefore, the turning force (the couple of forces) acting on the torsion spring 51 can be suppressed with the turning force before and after the phase conversion of the exhaust VTC being substantially the same. Accordingly, it is possible to suppress an occurrence of falling down or tipping of the torsion spring 51 to one side with respect to an axis of the torsion spring 51, thereby maintaining an attitude of the torsion spring 51 in an almost upright position with stability.

The spring force (the urging force) of the torsion spring 51 can therefore act on the vane rotor 21 with stability. Also it is possible to suppress a case where the torsion spring 51 unintentionally comes off the exhaust VTC due to the falling down of the torsion spring 51.

Since no additional or special mechanism to suppress the coming off of the torsion spring 51 is needed, increase in a component count and increase in complexity can be suppressed.

Further, in this embodiment, the both end portions 51*a* and 51*b* of the torsion spring 51 are bent in the radial direction. Thus, as compared with a case where the both end portions 51*a* and 51*b* are bent in the axial direction, an entire length of the exhaust VTC can be shortened.

Additionally, the part 51*c* of the front end side of the torsion spring 51 is housed or held in the inside of the concave portion 19 formed in the rear plate 13. Setting space of the torsion spring 51 can therefore shift inward by a length of the part 51*c*, and the entire length in the axial direction of the exhaust VTC can be shortened.

Since the part 51*c* of the front end side of the torsion spring 51 is housed in the inside of the concave portion 19, even if the torsion spring 51 tips to one side, the torsion spring 51 is guided or supported by the concave portion 19. Thus the torsion spring 51 is prevented from widely tipping to the one side.

Since the stopper protrusion 20 and the stopper groove 50 are formed in the rear plate 13 and the vane rotor 21 respectively, there is no need to perform the press-fitting process of a pin for retaining the torsion spring 51. This brings decrease in the component count and facilitates the assembly.

Further, since the female screw hole 13*b* is formed in each of the boss portions 19*a* to 19*d*, an engagement length of a part where the bolt 14 screws in the female screw hole 13*b* increases. Thus the strength of connection can be increased.

Moreover, since there is no need to form additional convex or protuberance portions for only improving the strength of each female screw hole 13*b*, increase in weight can be suppressed.

The present invention is not limited to the above embodiment. In the above embodiment, the middle position between the most-advanced angle side and the most-retarded angle side is set as a center position between the most-advanced angle side and the most-retarded angle side. Then the angle θ of the center position is set to 180°, and bending angles θ1 and θ3 of the most-advanced angle side and the most-retarded angle side are set to almost 165° and almost 195° respectively. However, the middle position is not necessarily the center position. The middle position includes a position that shifts to the most-advanced angle side and the most-retarded angle side. In this case, the angles θ1 and θ3 of the most-advanced angle side and the most-retarded angle side could be relatively changed. That is, the bending angles θ1 and θ3 of the most-advanced angle and the most-retarded angle are set to the respective angles, one of which is positioned at one side of the boundary, the other of which is positioned at the other side of the boundary with 180° being the boundary.

From the foregoing, the present invention has the following effects.

The variable valve timing control apparatus of an internal combustion engine, has the housing 5 to which the turning force is transmitted by the engine crankshaft and which has a plurality of the working fluid chambers in the inner circumference of the housing 5; the vane member 7 rotatably housed in the housing 5 and dividing the each working fluid chamber into the advance oil chamber 10 and the retard oil chamber 9, the vane member 7 rotating to the most-advanced angle side and to the most-retarded angle side within the predetermined angle range relative to the housing 5; and the torsion spring 51, one end 51*a* of which is retained by the housing 5 and the other end 51*b* of which is retained by the vane member 7, and when the vane member 7 rotates to the most-advanced angle side and to the most-retarded angle side relative to the housing 5, the angle θ in the circumferential direction formed by the line Z connecting the one end 51*a* and the other end 51*b* of the torsion spring 51 through the axial center P of the vane member 7 ranges from the angle θ1 positioned at one side to the angle θ3 positioned at the other side of the boundary with 180° being the boundary.

With this configuration, the attitude of the torsion spring 51 can be maintained in an almost upright position with stability.

In the variable valve timing control apparatus, when the vane member 7 (the vane rotor 21) rotates relative to the housing 5 and is positioned in the substantially middle position between the most-advanced angle side and the most-retarded angle side, the angle θ in the circumferential direction formed by the line Z connecting the one end 51*a* and the other end 51*b* of the torsion spring 51 through the axial center P of the vane member 7 is 180°.

By bringing the angle θ formed by the one end portion 51*a* and the other end portion 51*b* of the torsion spring 51 through the axial center P of the vane rotor 21 close to 180°, the turning force (the couple of forces) acting on the torsion spring 51 can be suppressed.

Further, even when the relative rotational phase of the exhaust VTC shifts, by setting the angle θ so as to be 180°, the turning force (the couple of forces) acting on the torsion spring 51 can be suppressed with the turning force before and after the phase conversion of the exhaust VTC being substantially the same. Accordingly, it is possible to suppress the occurrence of falling down or tipping of the torsion spring 51 to one side with respect to the axis of the torsion spring 51, thereby maintaining the attitude of the torsion spring 51 in the almost upright position with stability. The spring force (the urging force) of the torsion spring 51 can therefore act on the vane rotor 21 with stability. Also it is possible to suppress the case where the torsion spring 51 unintentionally comes off the exhaust VTC due to the falling down of the torsion spring 51.

Furthermore, since no additional or special mechanism to suppress the coming off of the torsion spring 51 is needed, increase in the component count and increase in complexity can be suppressed.

In the variable valve timing control apparatus, the angle θ when the vane member 7 (the vane rotor 21) is positioned in the middle position is set to an angle of ±5° of 180°.

With this setting, the same effects as mentioned above can be obtained.

In the variable valve timing control apparatus, the one end 51*a* and the other end 51*b* of the torsion spring 51 are bent in the radial direction, and retained by stopper portions 20, 50 formed in the housing 5 and the vane member 7 (the vane rotor 21) respectively.

The both end portions 51*a* and 51*b* of the torsion spring 51 are bent in the radial direction. Thus, as compared with a case where the both end portions 51*a* and 51*b* are bent in the axial direction, the entire length of the exhaust VTC can be shortened. In addition, since the stopper portions (the stopper protrusion 20 and the stopper groove 50) are formed in the housing 5 (the rear plate 13) and the vane member 7 (the vane rotor 21) respectively, there is no need to perform the press-fitting process of the pin for retaining the torsion spring 51. This brings decrease in the component count and facilitates the assembly.

In the variable valve timing control apparatus, the vane member 7 has the vane rotor 21 provided in the middle of the vane member 7 and the plurality of vanes 22 to 25 protruding from the outer circumferential surface of the rotor 21 in the radial direction, and the vane rotor 21 is provided, at one end portion in the axial direction thereof, with the cylindrical portion 21*b* that extends in the axial direction and is fixed to the camshaft 2, and the cylindrical portion 21*b* is provided with the stopper groove 50 that is formed along the radial direction as the stopper portion, and the other end 51*b* of the torsion spring 51, which is bent in the radially inward direction, is inserted in and retained by the stopper groove 50.

In the variable valve timing control apparatus, the one end 51*a* of the torsion spring 51 is bent in the radially outward direction, and is retained by the side surface (the outer end surface) 20*a* of the protruding portion 20 that is formed in the housing 5 as the stopper portion.

In the variable valve timing control apparatus, the housing 5 has the housing main body 11 that has a plurality of the working fluid chambers in the inner circumference thereof, the front plate 12 that closes the front side opening end of the housing main body 11, and the rear plate 13 that closes the rear side opening end, which is the camshaft 2 side, of the housing main body 11, and these three components are tightened and connected together by a plurality of the bolts 14, and the protruding portion 20 is provided with the female screw hole 13*b* for receiving the bolt 14.

Since the female screw hole 13*b* is formed in the protruding portion 20 that maintains the torsion spring 51, the engagement length of the part where the bolt 14 screws in the female screw hole 13*b* increases. Thus the strength of connection can be increased.

Additionally, since there is no need to form additional convex or protuberance portions for only improving the strength of each female screw hole 13*b*, increase in weight can be suppressed.

In the variable valve timing control apparatus, the rear plate 13 has the recessed space (the concave portion) 19 on the rear end surface, which is the camshaft side, of the rear plate 13, and a part 51*c* of the torsion spring 51 is housed in the recessed space 19.

Since the part 51*c* of the front end side of the torsion spring 51 is housed in the recessed space 19 formed in the housing main body 11, even if the torsion spring 51 tips to one side, the torsion spring 51 is guided or supported by the recessed space 19. Thus the torsion spring 51 is prevented from widely tipping to the one side. In addition, setting space of the torsion spring 51 can therefore shift inward by the length of the part 51*c*, and the entire length in the axial direction of the exhaust VTC can be shortened.

The variable valve timing control apparatus of the internal combustion engine has the drive rotary member (the timing sprocket) 1 to which the turning force is transmitted by the engine crankshaft; the driven rotary member (the camshaft) 2 which is capable of rotating within the predetermined angle range relative to the drive rotary member 1; and the torsion spring 51, one end 51*a* of which is retained by the drive rotary member 1 and the other end 51*b* of which is retained by the driven rotary member 2, and when the driven rotary member 2 rotates relative to the drive rotary member 1 and is positioned in the substantially middle position within the predetermined angle range, the angle θ in the circumferential direction formed by the line Z connecting the one end 51*a* and the other end 51*b* of the torsion spring 51 through the axial center P of the driven rotary member 2 is 180°.

With this configuration, the attitude of the torsion spring 51 can be maintained in the almost upright position with stability.

The variable valve timing control apparatus of an internal combustion engine has the drive rotary member (the timing sprocket) 1 to which the turning force is transmitted by the engine crankshaft; the driven rotary member (the camshaft) 2 which is capable of rotating within the predetermined angle range relative to the drive rotary member 1; and the torsion spring 51, one end 51*a* of which is retained by the drive rotary member 1 and the other end 51*b* of which is retained by the driven rotary member 2, and the angle θ in the circumferential direction formed by the line Z connecting the one end 51*a* and the other end 51*b* of the torsion spring 51 through the axial center P of the driven rotary member 2 when the driven rotary member 2 rotates relative to the drive rotary member 1 and is positioned in the middle position of the predetermined angle range is set to the angle of ±5° of 180°.

With this configuration, the attitude of the torsion spring 51 can be maintained in the almost upright position with stability.

The entire contents of Japanese Patent Application No. 2011-003794 filed on Jan. 12, 2011 are incorporated herein by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A variable valve timing control apparatus of an internal combustion engine, comprising:

a housing to which a turning force is transmitted by an engine crankshaft and which has a plurality of working fluid chambers in an inner circumference of the housing;

a vane member rotatably housed in the housing and dividing the each working fluid chamber into an advance oil chamber and a retard oil chamber, the vane member rotating to a most-advanced angle side and to a most-retarded angle side within a predetermined angle range relative to the housing; and a torsion spring, one end of which is retained by the housing and the other end of which is retained by the vane member, and when the vane member rotates to the most-advanced angle side and to the most-retarded angle side relative to the housing, an angle in a circumferential direction formed by a line connecting the one end and the other end of the torsion spring through an axial center of the vane member ranging from an angle positioned at one side to an angle positioned at the other side of a boundary with 180° being the boundary.

2. The variable valve timing control apparatus of the internal combustion engine as claimed in claim 1, wherein:

when the vane member rotates relative to the housing and is positioned in a substantially middle position between the most-advanced angle side and the most-retarded angle side, the angle in the circumferential direction formed by the line connecting the one end and the other end of the torsion spring through the axial center of the vane member is 180°.

3. The variable valve timing control apparatus of the internal combustion engine as claimed in claim 2, wherein:

the angle when the vane member is positioned in the middle position is set to an angle of ±5° of 180°.

4. The variable valve timing control apparatus of the internal combustion engine as claimed in claim 1, wherein:

the one end and the other end of the torsion spring are bent in a radial direction, and retained by stopper portions formed in the housing and the vane member respectively.

5. The variable valve timing control apparatus of the internal combustion engine as claimed in claim 4, wherein:

the vane member has:

(a) a vane rotor provided in a middle of the vane member; and (b) a plurality of vanes protruding from an outer circumferential surface of the rotor in the radial direction, and the vane rotor is provided, at one end portion in an axial direction thereof, with a cylindrical portion that extends in the axial direction and is fixed to a camshaft, and the cylindrical portion is provided with a stopper groove that is formed along the radial direction as the stopper portion, and the other end of the torsion spring, which is bent in a radially inward direction, is inserted in and retained by the stopper groove.

6. The variable valve timing control apparatus of the internal combustion engine as claimed in claim 4, wherein:

the one end of the torsion spring is bent in a radially outward direction, and is retained by a side surface of a protruding portion that is formed in the housing as the stopper portion.

7. The variable valve timing control apparatus of the internal combustion engine as claimed in claim 6, wherein:

the housing has:

(a) a housing main body that has a plurality of the working fluid chambers in an inner circumference thereof;

(b) a front plate that closes a front side opening end of the housing main body; and (c) a rear plate that closes a rear side opening end, which is a camshaft side, of the housing main body, and these three components are tightened and connected together by a plurality of bolts, and the protruding portion is provided with a female screw hole for receiving the bolt.

8. The variable valve timing control apparatus of the internal combustion engine as claimed in claim 7, wherein:

the rear plate has a recessed space on a rear end surface, which is the camshaft side, of the rear plate, and a part of the torsion spring is housed in the recessed space.

9. The variable valve timing control apparatus of the internal combustion engine as claimed in claim 1, wherein when the driven rotary member rotates to an advanced angle side the angle becomes less than 180°, and when the driven rotary member rotates to a retarded angle side the angle becomes greater than 180°.

10. The variable valve timing control apparatus of the internal combustion engine as claimed in claim 1, wherein the other end of the torsion spring is engaged with the vane member at all times when the vane member rotates and the angle in the circumferential direction is less than 180° or greater than 180°.

11. A variable valve timing control apparatus of an internal combustion engine, comprising:

a drive rotary member to which a turning force is transmitted by an engine crankshaft;

a driven rotary member which is capable of rotating within a predetermined angle range relative to the drive rotary member; and a torsion spring, one end of which is retained by the drive rotary member and the other end of which is retained by the driven rotary member, wherein when the driven rotary member rotates relative to the drive rotary member and is positioned in a substantially middle position within the predetermined angle range, an angle, in a circumferential direction formed by a line connecting the one end and the other end of the torsion spring through an axial center of the driven rotary member, is 180°, and when the driven rotary member rotates to an advanced angle side and to a retarded angle side, the angle crosses 180°.

12. The variable valve timing control apparatus of the internal combustion engine as claimed in claim 11, wherein when the driven rotary member rotates to an advanced angle side the angle becomes less than 180°, and when the driven rotary member rotates to a retarded angle side the angle becomes greater than 180°.

13. The variable valve timing control apparatus of the internal combustion engine as claimed in claim 11, wherein the other end of the torsion spring is engaged with the driven rotary member at all times when the driven rotary member rotates and the angle in the circumferential direction is less than 180° or greater than 180°.

14. A variable valve timing control apparatus of an internal combustion engine, comprising:

a drive rotary member to which a turning force is transmitted by an engine crankshaft;

a driven rotary member which is capable of rotating within a predetermined angle range relative to the drive rotary member; and a torsion spring, one end of which is retained by the drive rotary member and the other end of which is retained by the driven rotary member, wherein an angle, in a circumferential direction formed by a line connecting the one end and the other end of the torsion spring through an axial center of the driven rotary member when the driven rotary member rotates relative to the drive rotary member and is positioned in a middle position of the predetermined angle range, is set to range between 180°±5°, and when the driven rotary member rotates to an advanced angle side and to a retarded angle side, the angle crosses 180°.

15. The variable valve timing control apparatus of the internal combustion engine as claimed in claim 14, wherein when the driven rotary member rotates to an advanced angle side the angle becomes less than 180°, and when the driven rotary member rotates to a retarded angle side the angle becomes greater than 180°.

16. The variable valve timing control apparatus of the internal combustion engine as claimed in claim 14, wherein the other end of the torsion spring is engaged with the driven rotary member at all times when the driven rotary member rotates and the angle in the circumferential direction is less than 180° or greater than 180°.

* * * * *